US006947694B2

(12) United States Patent
Saito

(10) Patent No.: US 6,947,694 B2
(45) Date of Patent: Sep. 20, 2005

(54) BELT WHOSE $\epsilon_{BREAK}/\epsilon_{MAX}$ RATIO IS WITHIN A PREDETERMINED RANGE AND IMAGE FORMING APPARATUS HAVING SUCH BELT

(75) Inventor: Makoto Saito, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/462,785

(22) Filed: Jun. 17, 2003

(65) Prior Publication Data

US 2004/0042824 A1 Mar. 4, 2004

(30) Foreign Application Priority Data

Jun. 24, 2002 (JP) ..... 2002/182833

(51) Int. Cl.[7] ..... G03D 15/01; G03G 15/16
(52) U.S. Cl. ..... 399/302; 399/162; 399/303
(58) Field of Search ..... 399/302, 303, 399/162, 308, 312, 313, 159

(56) References Cited

U.S. PATENT DOCUMENTS

| | | | | |
|---|---|---|---|---|
| 5,475,472 | A | 12/1995 | Saito et al. | 355/219 |
| 5,669,042 | A | 9/1997 | Kobayashi et al. | 399/111 |
| 2003/0044198 | A1 | 3/2003 | Kato et al. | 399/109 |

FOREIGN PATENT DOCUMENTS

| | | | |
|---|---|---|---|
| DE | 19531281 C1 * | 2/1997 | F16G/1/00 |
| JP | 10-207243 | 8/1998 | |
| JP | 11-167290 | 6/1999 | |

* cited by examiner

*Primary Examiner*—Quana Grainger
(74) *Attorney, Agent, or Firm*—Fitzpatrick, Cella, Harper & Scinto

(57) ABSTRACT

A belt extends a plurality of rollers, and bears thereon an image formed by an image forming device or a transfer material onto which the image is transferred. The belt satisfies the following relationship: $1.5 \leqq \epsilon_{break}/\epsilon_{max} \leqq 10$, wherein $\epsilon_{max}$ represents the strain at the time of applying to the belt a maximum stress value obtained from a stress-strain curve measured in accordance with JIS K7161, and $\epsilon_{break}$ represents the strain at a breaking point of the belt.

14 Claims, 6 Drawing Sheets

| | EX.1 | EX.2 | EX.3 | EX.4 | COMP.EX.1 | COMP.EX.2 | COMP.EX.3 |
|---|---|---|---|---|---|---|---|
| Base Material | polyimide | PC | SiPC | SiPC | PET | PVDF | nylon |
| Filler | carbon20% | carbon20% | carbon6% | carbon8% | carbon20% | carbon16% | carbon20% |
| Thickness ($\mu$m) | 75 | 90 | 100 | 100 | 100 | 100 | 115 |
| Rupture | No | No | No | No | Yes (X) | No | No |
| Image failure due to pemanent defomation | No | No | No | No | No | Yes (X) | Yes (X) |
| $\varepsilon_{break}/\varepsilon_{max}$ | 3.81 | 4.68 | 5.57 | 4.96 | 1.09 | 110.27 | 10.48 |

FIG. 3

BELT WHOSE $\epsilon_{BREAK}/\epsilon_{MAX}$ RATIO IS WITHIN A PREDETERMINED RANGE AND IMAGE FORMING APPARATUS HAVING SUCH BELT

FIELD OF THE INVENTION AND RELATED ART

The present invention relates to an intermediate transfer belt, for an image forming apparatus, which transfers an image onto a transfer material to provide an image or relates to a transfer material carrying belt.

FIG. 5 is a schematic structural view showing an embodiment of a conventional tandem type full-color image forming apparatus (e.g., a full-color copying machine).

Referring to FIG. 5, the image forming apparatus includes four photosensitive drums 100*a*, 100*b*, 100*c* and 100*d* which are respectively rotationally driven and uniformly charged by chargers 101*a*, 101*b*, 101*c* and 101*d*, respectively, and then are subjected to scanning exposure on the basis of image information by exposure apparatus 102*a*, 102*b*, 102*c* and 102*d*, respectively, to form thereon an electrostatic latent image, respectively.

The respective electrostatic latent images are developed by developing devices 103*a*, 103*b*, 103*c* and 103*d*, respectively. The developing devices 103*a*, 103*b*, 103*c* and 103*d* contain a yellow toner, a magenta toner, a cyan toner, and black toner, respectively. An electrostatic image for a first color formed on the photosensitive drum 100*a* is developed by the developing device 103*a* for yellow to be visualized as a yellow toner image.

The thus formed yellow toner image is transferred onto a transfer material P, such as a sheet, which is carried on an endless transfer belt 105 by adsorption through a transfer blade 107*a* supplied with a transfer bias, at a transfer portion N1 where the endless transfer belt 105 and the photosensitive drum 103*a* contact each other. The transfer belt 105 is extended around a drive roller 106*d* and rollers 106*b*, 106*c* and 106*a*, which are driven by rotation of the drive roller 106*d*, and is rotated (moved) by drive of the driving roller 106*d* in a direction of an arrow (indicated along the belt 105). The photosensitive drum 100*a* after completion of the transfer is subjected to a subsequent image-forming process after a transfer residual toner remaining on the surface of the photosensitive drum 100*a* is removed by a cleaner 108*a*.

In a similar manner, the photosensitive drum 100*b* is subjected to charging by the charger 101*b* and scanning exposure by the exposure apparatus 102*b* on the basis of image formation to form thereon an electrostatic latent image for a second color, which is developed by the developing device 103*b* to form a magenta toner image. The magenta toner image is transferred onto the yellow toner image, in superposition, which has already been transferred onto the transfer material P adsorbed and carried by the transfer belt 105. This magenta-toner-image transfer is accomplished by adsorption through a transfer blade 107*b* supplied with a transfer bias, at a transfer portion N2 where the endless transfer belt 105 and the photosensitive drum 103*b* contact each other.

The above steps are repeated with respect to image formation for cyan and black, whereby a cyan toner image and a black toner image are successively transferred in superposition onto the transfer material P which is adsorbed and carried on the transfer belt 105. More specifically, the cyan-toner-image transfer is accomplished by adsorption through a transfer blade 107*c* supplied with a transfer bias, at a transfer portion N3 where the endless transfer belt 105 and the photosensitive drum 103*c* contact each other, and the black-toner-image transfer is accomplished by adsorption through a transfer blade 107*d* supplied with a transfer bias, at a transfer portion N4 where the endless transfer belt 105 and the photosensitive drum 103*d* contact each other. As a result, on the transfer material P adsorbed and carried by the transfer belt 105, is a color image comprising superposed four-color toner images of yellow, magenta, cyan and black. The transfer material P onto which the (superposed) four-color toner images are transferred is separated from the transfer belt 105 and is carried to a fixing device 109 by which the four-color toner images are heated and pressed to perform hot fixation on the surface of the transfer paper P, which is discharged outside the image forming apparatus.

However, in such an image forming apparatus, the transfer belt (endless belt) which is rotationally driven under tension may accompanied by the following two problems.

A first problem is that there is a possibility of the occurrence of image failure due to a permanent deformation of the transfer belt.

As shown in FIG. 6, the transfer belt 105 is extended around at least two rollers including the drive roller 106*d* to be rotationally driven by drive means and a tension roller 106*a* for applying a tension for extending the belt around the rollers.

In a state in which the rollers are not driven, if the tension is continuously applied to the belt, as shown in FIG. 7, a wavy creep (permanent deformation) C is caused to occur at portions where the belt is wound about the rollers in a thrust direction of the belt. At the portions where such a waving is caused to occur, image failure is liable to occur. This is attributable to the occurrence of irregularity in resistance at a transfer nip due to the waving. As shown in FIG. 8, in the case where the belt on which the waving is caused to occur is used, the transfer belt P is not properly adsorbed by the belt 105. Further, gaps are formed between the transfer blade 107*a* and the underside of the transfer belt 105. When some gaps are formed in the thrust direction as described above, portions where the gaps are formed are supplied with an electric field smaller than that at other portions where the transfer nip is properly created, thus causing the resistance irregularity.

A second problem is that there is a possibility of rupture of the belt due to a tension which is locally applied. From a macroscopic viewpoint, it is possible to determine the magnitude of the tension applied to the belt by measuring torques of the respective rollers at the time of driving Generally, a torque of a roller has a maximum value at the time of start of driving compared with the time when the roller is driven in stable action, so that it can be said that the tension applied to the belt is largest at the time of the start of driving. In order to prevent the belt from being broken, a material having an appropriate elastic limit is used as a material for the belt.

However, it is difficult to uniformize the macroscopic tension applied to the belt in a plane where the belt is extended. This is attributable to non-uniformity of the endless belt in terms of its material or a slight deviation of alignment of the belt-extension mechanism. The non-uniformity of the belt material may, e.g., include a thickness irregularity of the belt, nonuniform dispersion of an electroconductive filler and non-uniformity in crystallization of a resin.

The thickness irregularity of the belt causes an unevenness of stress in the belt-extension mechanism, and the stress may locally exceed the tensile strength of the belt to cause permanent deformation, and at worst, rupture of the belt. Further, the incorporation of the filler can be regarded as the presence of molecular-structure defects at spots where the filler is present, so that there is a possibility that the strength of the belt is locally lowered. As a result, in a state in which the electroconductive filler is non-uniformly dispersed, there is a possibility that the rupture is liable to occur in spots where the filler is concentrated.

Further, progress of crystallization of the resin is locally caused to occur, so that the material possessing the non-uniformity exhibits energy elasticity at the spots where the crystallization progresses, thus lowering its elasticity compared with a high elasticity limit attributable to its original entropic elasticity. As a result, there is the possibility of the occurrence of belt rupture.

Further, stress unevenness may occur also due to the alignment deviation of the beltextension mechanism. The alignment deviation accelerates the bias of the seamless belt in its thrust direction and is suppressed by regulation with ribs. However, when such ribs abut a rib guide, the ribs apply to the rib guide such a shearing stress as to press the rib guide, so that the belt is rotationally driven in such a state that it moves partially onto the rib guide. As a result, an uneven torque due to friction between the rib and the rib guide is caused to occur, thus leading to an unevenness of tension in the belt-extension plane.

Even if the regulation by the rib guide is not performed, the alignment deviation cannot be negligible. In such a case, it may be assumed that a large tension is applied diagonally to the belt in the belt-extension plane, thus leading to the unevenness of tension.

The unevenness of stress due to those factors generates locally a large stress. If such a localized large stress exceeds the tensile rupture strength of the belt, there is a possibility of rupture of the belt.

Incidentally, Japanese Laid-Open Patent Application (JP-A) Hei 10-207243 and JP-A 11-167290 have proposed solutions to problems, such as distortion or deformation of an endless belt but have failed to provide sufficient belt performance.

SUMMARY OF THE INVENTION

An object of the present invention is to provide a belt capable of preventing image failure due to waving of the belt and rupture of the belt.

Another object of the present invention is to provide an image forming apparatus employing the belt.

According to the present invention, there is provided a belt for extending around a plurality of rollers and bearing thereon an image formed by image forming means or a transfer material onto which the image is transferred, the belt satisfying the following relationship:

$$1.5 \leqq \epsilon_{break}/\epsilon_{max} \leqq 10,$$

wherein $\epsilon_{max}$ represents the strain experienced by said belt at the time of applying to the belt a maximum stress value obtained from a stress-strain curve measured in accordance with JIS K7161, and $\epsilon_{break}$ represents the strain experienced by the belt at a breaking point thereof.

According to the present invention, there is also provided an image forming apparatus, comprising:

image forming means for forming an image, a belt for bearing thereon the image or a transfer material onto which the image is transferred, and a plurality of rollers around which the belt is extended;

wherein the belt satisfies the following relationship:

$$1.5 \leqq \epsilon_{break}/\epsilon_{max} \leqq 10,$$

wherein $\epsilon_{max}$ represents the strain experienced by said belt at the time of applying to the belt a maximum stress value obtained from a stress-strain curve measured in accordance with JIS K7161, and $\epsilon_{break}$ represents the strain experienced by the belt at a breaking point thereof.

These and other objects, features and advantages of the present invention will become more apparent upon a consideration of the following description of the preferred embodiments of the present invention taken in conjunction with the accompanying drawings.

BRIEF DESCRIPTION OF THE DRAWINGS

FIG. 3 shows the results of evaluation of Embodiments 1–4 and Comparative Embodiments 1–3.

DETAILED DESCRIPTION OF THE PREFERRED EMBODIMENT

Figure 1:
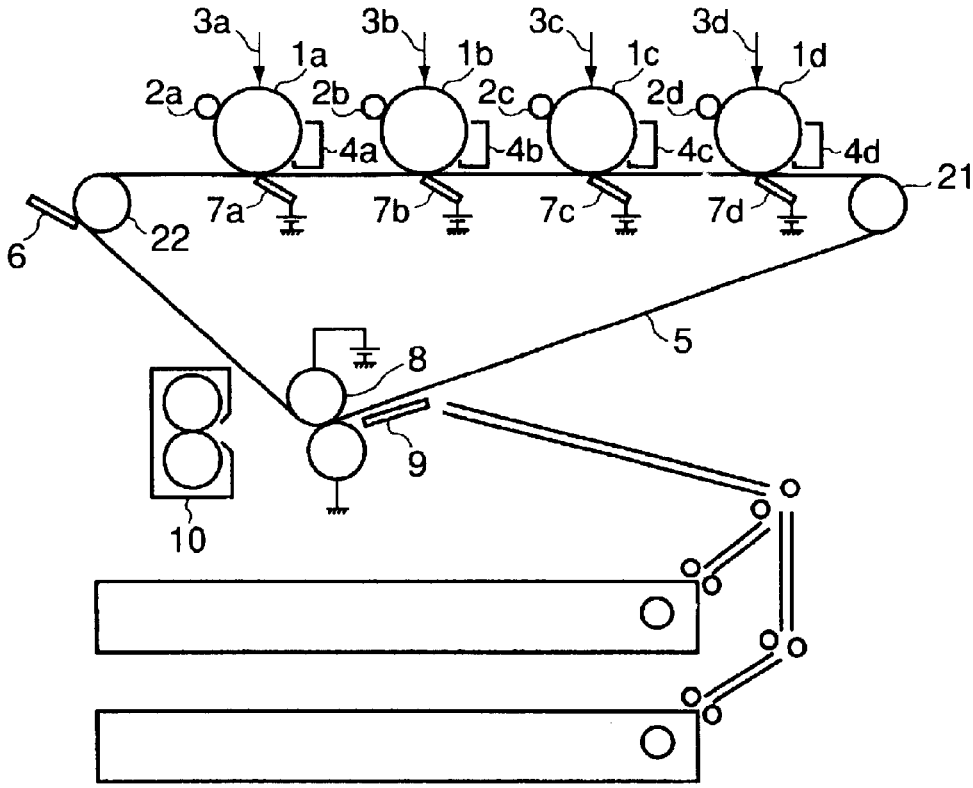
FIG. 1 is a schematic sectional view for illustrating an image forming apparatus according to the present invention.

Preferred embodiments of the present invention will be described with reference to the drawings.

An endless belt according to the present invention comprises a base material made of a resin and an electroconductive filler contained in the resin.

The resin for the base material may include, e.g., resinous materials, such as polyimide, polyester, polyether ketone, nylon (polyamide), polycarbonate, polyvinylidene difluoride (PVDF), and fluoroethylene-ethylene copolymer (ETFE).

On the other hand, examples of the electroconductive filler may include carbon black, metals (aluminum, nickel, copper, etc.), alloys of these metals, metal oxides (tin oxide, zinc oxide, etc.) and an inorganic oxide (such as potassium titanate). Of these, carbon black such as furnace black, ketjen black, channel black, etc, can be used.

Further, it is also possible to mix a polymer having ion conductivity as the filler. For example, it is possible to mix polyaniline (emeraldine-based) or polythiophene into the resin together with a dopant such as iodine. Further, it is possible to incorporate ionic electrolyte as the filler into the resin. Examples of the ionic electrolyte may include potassium thiocyanate and potassium perchlorate.

The thickness of the endless belt according to the present invention may appropriately be determined in view of its intended purpose, but may generally preferably be 20–500 $\mu$m, particularly 50–130 $\mu$m. The endless belt of the present invention may be used as an intermediary transfer belt for temporarily bearing a toner image formed on an image bearing member and then secondary-transferring the toner image onto a transfer material P. Further, the endless belt of the present invention may also be used as a transfer material carrying (conveyance) belt for carrying the transfer material P to a transfer area where the toner image formed on the image bearing member is transferred onto the transfer material P.

The endless belt of the present invention is a semiconductive belt and can be installed in the following image forming apparatus (e.g., a fall-color copying machine). The image forming apparatus includes a first transfer means for primary-transferring a toner image formed on the image bearing member and a second transfer means for secondary-transferring the toner image transferred onto an intermediary transfer member, and also employs the endless belt of the present invention as the intermediary transfer member, thus being of an intermediary transfertype belt. The image forming apparatus may be one provided with the endless belt of the present invention as a transfer-material carrying belt for carrying the transfer material to the transfer area where the toner image is transferred onto the transfer material.

The image forming apparatus of the present invention is not particularly limited to the above-mentioned image forming apparatus. For example, it is possible to use, as the image forming apparatus, an ordinary monochromatic image forming apparatus including a developing device containing only a monochromatic toner, a color image forming apparatus in which a toner image borne on an image bearing member is successively primary-transferred repetitively onto an intermediary transfer member, or a tandem-type color image forming apparatus including a plurality of image bearing members which are provided with developing devices for respective colors and are arranged in series on an intermediary transfer member.

More specifically, e.g., the image forming apparatus of the present invention may include an image bearing member, a charging means for uniformly charging the image bearing member surface, an exposure means for exposing the image bearing member surface to light thereby to form an electrostatic latent image, a developing means for developing the latent image with a developer to form a toner image, a fixing means for fixing the toner image on a transfer-receiving material, a cleaning means for removing toner or contamination attached to the image bearing member, and an optical charge-removing means for removing the electrostatic latent image remaining on the image bearing member surface. The image forming apparatus may be provided with these means in an ordinary manner as desired.

As the image bearing member, as conventionally known one may be used. Specifically, for its photosensitive layer, it is possible to use a known material such as an organic compound or amorphous silicon. In the case where the image bearing member is cylindrical, the image bearing member can be prepared by extruding aluminum or aluminum alloy and surface treating the extrusion in an ordinary production process. It is also possible to use a belt-shape image bearing member.

The charging means is not particularly limited. More specifically, e.g., as the charging means, it is possible to use known charging means such as a contact-type charger using an electroconductive or semiconductive member in the form of a roller, a brush, a film, a rubber blade, etc., and a scorotron or corotron charger utilizing corona discharge. Of these chargers, it is preferred to use the contact-type charger in view of its excellent charge-compensation ability. The charging means generally applies a DC current to the electrophotographic photosensitive member but may apply thereto a DC current biased with an AC current.

The exposure means is also not particularly limited. It is possible to use optical system equipment capable of exposing the surface of the electrophotographic photosensitive member to a desired imagewise light issued from a light source for semiconductor light, LED light, liquid crystal shutter light, etc., directly or via a polygon mirror.

The developing means may appropriately be selected depending upon its intended purpose, and may include, e.g., known developing devices in which development is performed by contacting or not contacting a developer of the monocomponent type or of the two-component type through a brush, a roller, etc.

The first transfer means may, e.g., be known transfer chargers, such as a contact-type transfer charger using a belt, a roller, a film, a rubber blade, etc.; a scorotron or corotron transfer charger utilizing corona discharge; and may preferably be the contact-type transfer charger excellent in transfer-charge compensation ability. In the present invention, in combination with the transfer charger, it is possible to use, e.g., a peeling charger.

As the second transfer means, it is possible to use the chargers exemplified as for the above first transfer charger, such as the contact-type transfer charger using, e.g., a roller; the scorotron-transfer charger, or the corotron-transfer charger. Of these chargers, similarly as in the first transfer charger, the contact type transfer charger is preferred. When the contact-type transfer charger, such as a transfer roller is strongly pressed, it is possible to retain a transfer state of an image in a good state. Further, when such a transfer roller is pressed at a position of a roller for guiding the intermediary transfer member, it becomes possible to transfer the toner image from the intermediary transfer member to the transfer material in a good state.

The optical charge-removing means may be, e.g., those using a tungsten lamp or a LED. Light for use in the optical charge-removing process may include white light issued from, e.g., the tungsten lamp and red light issued from, e.g. the LED. An irradiated light intensity in the optical charge-removing process is generally set to provide an output which is several times to about 30 times the amount of light required for providing a half decay exposure sensitivity of the electrophotographic photosensitive member.

The fixing means is not particularly limited. The fixing means may be a known fixing device, such as a hot roller fixing device, an oven fixing device or a belt fixing device.

The cleaning means is also not limited particularly but may be a known cleaning apparatus.

Hereinafter, the present invention will be described more specifically based on specific embodiments.

(Embodiment 1)

An endless belt was prepared by using polyimide as the base material and carbon black as the electroconductive filler contained in the base material in an amount of 20 wt. parts.

(Embodiment 2)

An endless belt was prepared by using polycarbonate (PC) as the base material and carbon black as the electroconductive filler contained in the base material in an amount of 20 wt. parts.

(Embodiment 3)

A seamless belt was prepared by using polycarbonate modified with Si (SiPC) as the base material and carbon black as the electroconductive filler contained in the base material. The carbon black was mixed in the SiPC in an amount of 6 wt. parts. The modification with Si was a treatment for improving dispersion property of the electroconductive filler.

(Embodiment 4)

A seamless belt was prepared by using polycarbonate modified with Si (SiPC) as the base material and carbon black as the electroconductive filler contained in the base material. The carbon black was mixed in the SiPC in an amount of 8 wt. parts.

(Comparative Embodiment 1)

An seamless belt was prepared by using polyethylene terephthalate (PET) as the base material and carbon black as the electroconductive filler contained in the base material in an amount of 20 wt. parts.

(Comparative Embodiment 2)

An seamless belt was prepared by using polyvinylidene fluoride (PVDF) as the base material and carbon black as the electroconductive filler contained in the base material in an amount of 16 wt. parts.

(Comparative Embodiment 3)

A seamless belt was prepared by using nylon as the base material and carbon black as the electroconductive filler contained in the base material in an amount of 20 wt. parts.

(Evaluation)

The endless (seamless) belts prepared in Embodiments 1–4 and Comparative Embodiments 1–3 were subjected to measurement of a stress-strain curve (S-S curve) with respect to test pieces cut therefrom, respectively, and observation as to whether rupture or image failure due to permanent deformation (creep) was caused to occur or not after a durability test wherein an ordinary image-forming operation was repetitively performed in an image forming apparatus.

More specifically, the measurement of the S-S curves was performed by using a desktoptype-materials testing machine ("STA-1225", mfd. by Orientec Co.) in accordance with JIS K7161 (test method) and JIS K7162 (test piece) under conditions including a crosshead speed of 100 mm/min, a width of test piece of 5 mm, a length of test piece of 100 mm, and an environment of 23 C and 50% RH. Each of the endless belts (seamless belts) prepared in Embodiments 1–and Comparative Embodiments 1–3 was installed in an image forming apparatus described below as the intermediary transfer belt and was subjected to image formation on 15×104 sheets in an intermittent mode. The presence or absence of a rupture and/or permanent deformation was observed by eyes of the tester.

The image forming apparatus used for evaluation is shown in FIG. 1, which is a schematic sectional view of the image forming apparatus.

Referring to FIG. 1, the image forming apparatus includes photosensitive drums 1*a*–1*d*, charging devices 2*a*–2*d*; exposure lights 3*a*–3*d*; developing devices 4*a*–4*d* for yellow, magenta, cyan and black, respectively; an intermediate transfer belt 5 extended around a plurality 15 of rollers 8, 21 and 22; and transfer blades 7*a*–7*d* for transferring developed images of yellow, magenta, cyan and black, respectively, onto the intermediate transfer belt 5. The transfer blades 7*a*–7*d* are controlled at a constant current.

In the image forming apparatus of an electrophotographic process shown in FIG. 1, the photosensitive drums 1*a*–1*d* are charged by the charging devices 2*a*–2*d*, to, e.g., a negative polarity, and exposed to the exposure lights 3*a*–3*d*, whereby electrostatic images are formed on the photosensitive drums 1*a*–1*d* and then are visualized by the developing devices 4*a*–4*d*. The thus developed respective color toner images are primary transferred in succession onto the intermediate transfer belt 5 by the transfer chargers (blades) 7*a*–7*d*. The color toner images are then secondary-transferred onto a transfer material 9 by a transfer charge roller 8, which is constant current-controlled, and conveyed to a fixing device 10, thus being fixed and formed on the transfer material 9 as a color image. The intermediate transfer belt 5 after the image formation is cleaned by a belt cleaner 6. The reference numeral 21 denotes a tension roller which applies a tension to the intermediate transfer belt 5 by using an unshown spring. The tension is not removed even when the image-forming operation is not performed. A total pressure of 7 kgf is applied as the tension to the intermediate transfer belt 5. The reference numeral 22 is a roller which is driven by the transfer charger roller 8.

Figure 2:
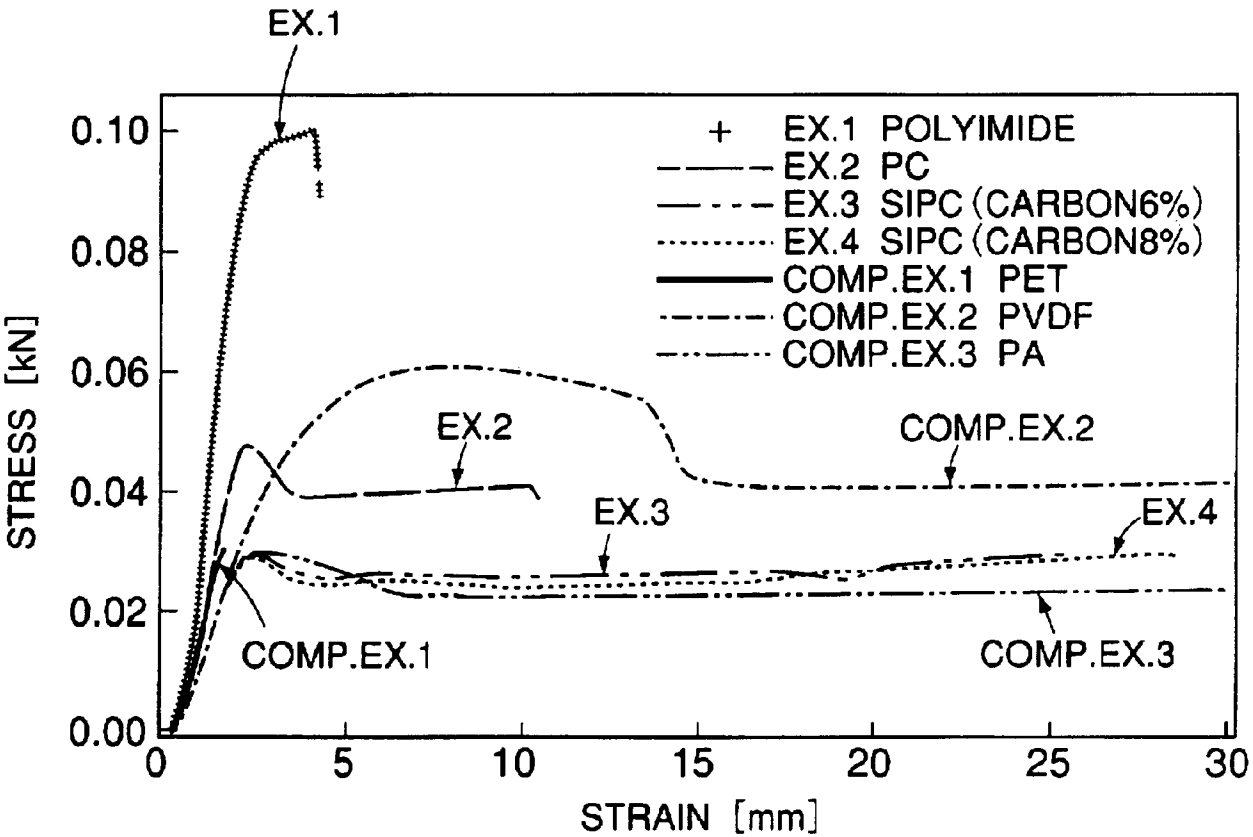
FIG. 2 is a graph showing stress-strain curves for belts used in Embodiments 1–4 and Comparative Embodiments 1–3 appearing hereinafter.

The evaluation results are shown in FIGS. 2 and 3.

As shown in FIG. 3, the belts of Comparative Embodiments 1–3 showed rupture of the belt or image failure due to permanent deformation of the belt. The reasons therefor will be explained by using S-S curves for these belts shown in FIG. 2.

More specifically, the PET belt of Comparative Embodiment 1 having an S-S curve indicated by a solid line in FIG. 2 is found to have no ductility at all as it causes a substantially linear strain when a stress is applied thereto and had ruptured at the instant when the stress reaches the yield stress. It may be conceivable that PET as the base material is crystallized, so that there is no entropy elasticity which provides ductility, and accordingly the PET belt is ruptured at the instance when the stress applied reaches the yield stress.

On the other hand, the PDF belt of Comparative Embodiment 2 and the PA (nylon) belt of Comparative Embodiment 3 have very large ductilities, so that the PVDF belt and the PA belt had not ruptured until they were ductiled by about 700 mm and about 50 mm, respectively. From the S-S curves for these belts shown in FIG. 2, it may be conceivable that linear polymers, such as nylon and PVDF with no side chain and a relatively large functional group, such as a benzene ring in their main chains, exhibit a very large degree of freedom within molecule and also permit their molecular rearrangement under the application of an external electric field, thus causing large deformation when creep is once generated. The image failure caused by permanent deformation of the belt material is largely affected by the degree of the deformation. Accordingly, it may be conceivable that image failure is caused to occur in the belts using nylon and PVDF as the base materials.

For these reasons, it is conceivable that a belt capable of achieving the objects of the present invention, i.e., prevention of image failure due to belt waving and prevention of rupture of the belt, is required to possess an "appropriate ductility" which is not excessively small nor excessively large.

Figure 4:
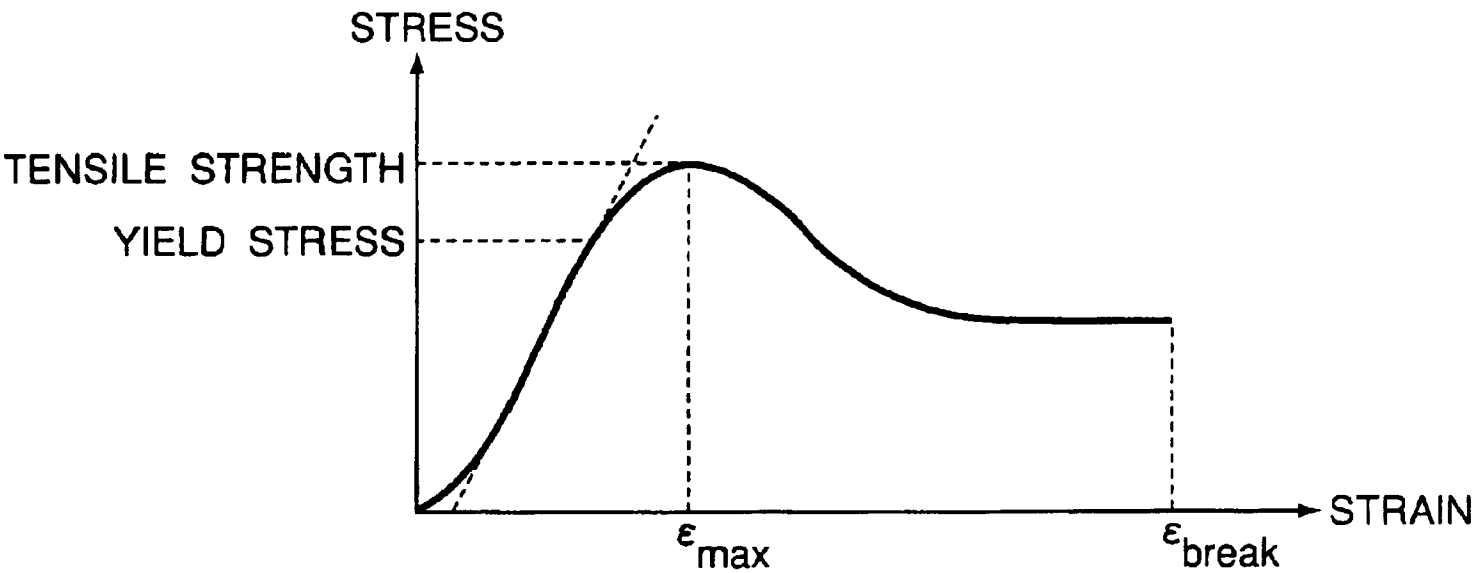
FIG. 4 is a graph for illustrating a parameter break/ max.
Figure 5:
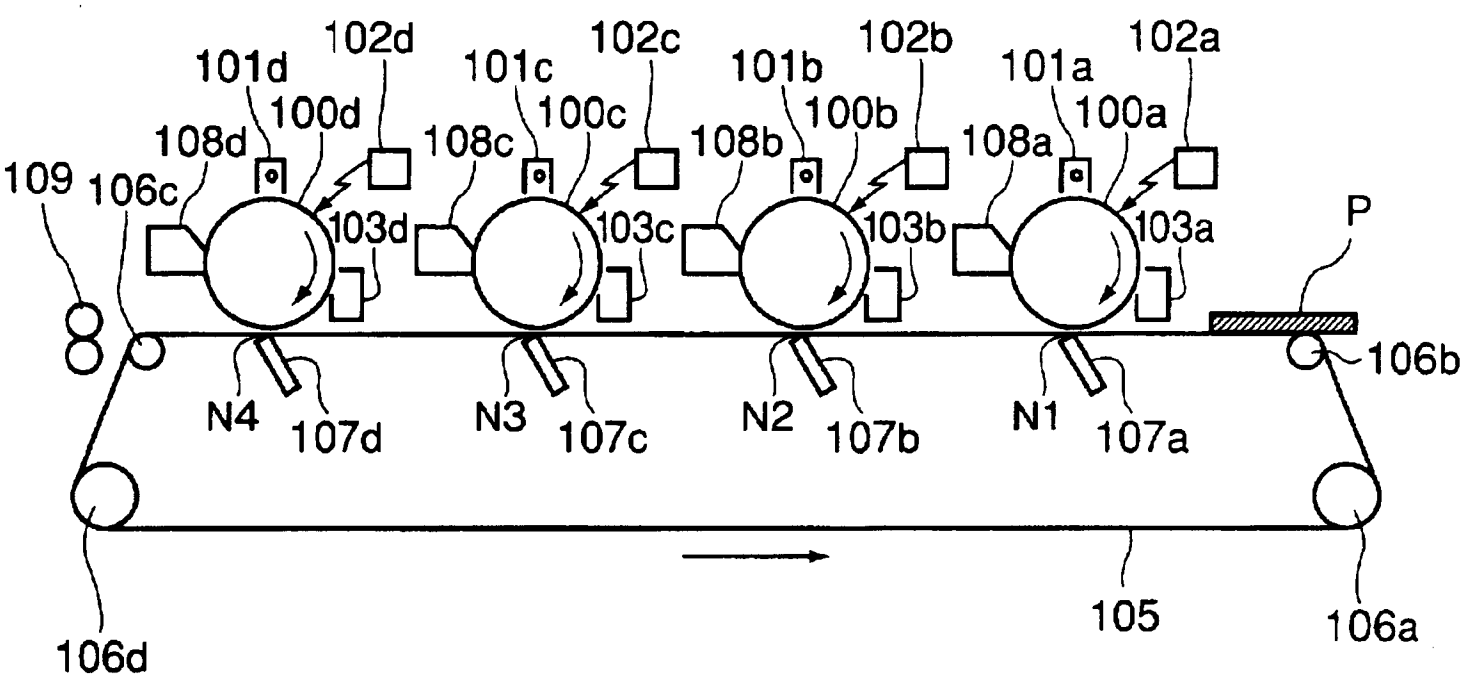
FIG. 5 is a schematic sectional view illustrating an embodiment of a conventional image forming apparatus.
Figure 6:
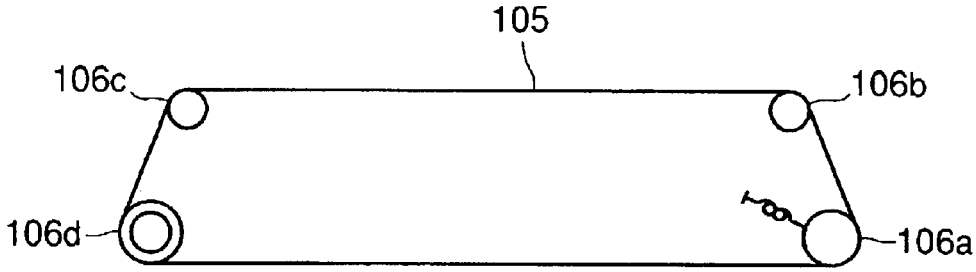
FIG. 6 is a view for explaining deformation of a belt.
Figure 7:
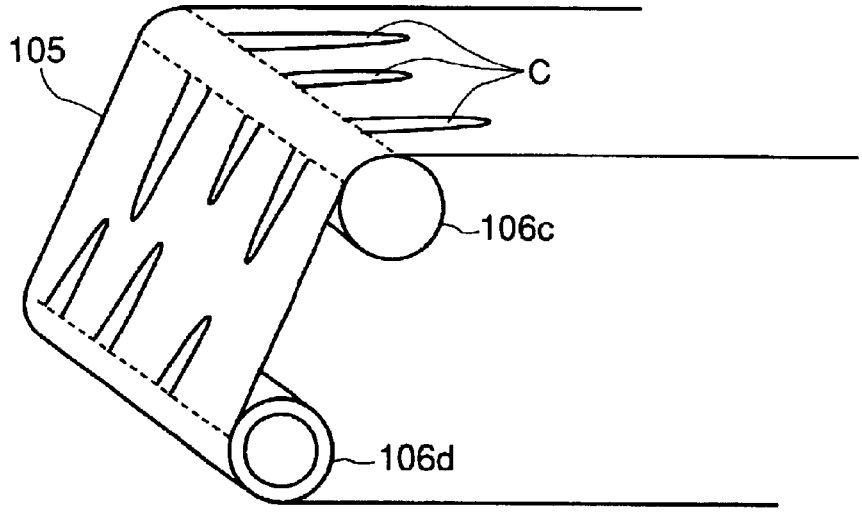
FIG. 7 is a view for explaining waving (deformation) of the belt.
Figure 8:
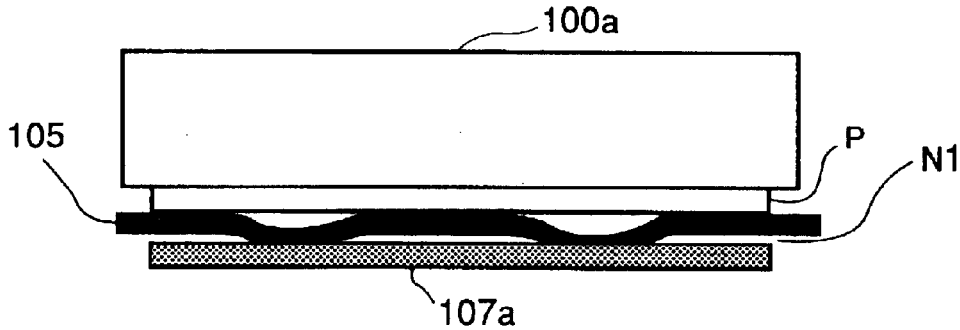
FIG. 8 is a view for explaining image failure due to the waving of the belt.

The appropriate ductility may be expressed by using a parameter "$\epsilon_{break}/\epsilon_{max}$" as shown in FIG. 3. Herein, $\epsilon_{break}$ represents the strain at a breaking point when a stress is applied to a test piece. $\epsilon_{max}$ represents the strain at the time of applying to a test piece a maximum stress value (tensile strength TS) obtained from a stress-strain (S-S) curve, as shown in FIG. 4.

The parameter ($\epsilon_{break}/\epsilon_{max}$) has a value not less than 1. If $\epsilon_{break}/\epsilon_{max}$ is 1, the material concerned is a material which is ruptured without causing deformation, i.e., which has no ductility at all. On the other hand, a large value of $\epsilon_{break}/\epsilon_{max}$ means that the belt concerned causes a larger deformation. As shown in FIG. 3, the belts which do not cause rupture nor image failure due to permanent deformation exhibit $\epsilon_{break}/\epsilon_{max}$ values of about 4–6.

The (crystallized) PET belt of Comparative Embodiment 1 exhibits the $\epsilon_{break}/\epsilon_{max}$ value of 1.09, which is closer to 1, and thus the material for the belt is a material causing no deformation. When such a belt using the material causing no deformation is rotationally driven under tension, it may be assumed that a fracture is generated due to the above-mentioned unevenness of stress in a place where a larger tension is locally applied, and during further rotational drive of the belt, the fracture becomes large to result in a rupture. Accordingly, from the viewpoint of prevention of an occurrence of fracture even when a larger tension which exceeds the belt elastic limit, the belt is required to possess a ductility which is not excessively small.

The ductility which is not excessively small is estimated as not less than 1.5, preferably not less than about 3, in terms of $\epsilon_{break}/\epsilon_{max}$.

Further, the belts of Comparative Embodiments 2 and 3, which exhibited permanent deformation and image failure show very large $\epsilon_{break}/\epsilon_{max}$ values of 10.48 and 110. Such belts using materials possessing large ductilities cause image failure due to deformation by stress relaxation as described above. Accordingly, the belt is also required to exhibit a ductility which is not excessively large, i.e., which is not more than 10, preferably not more than about 7, in terms of the $\epsilon_{break}/\epsilon_{max}$ value.

As a result, from the results of FIG. 3, by selecting a material providing an appropriate ductility satisfying: $1.5 \leqq \epsilon_{break}/\epsilon_{max} \leqq 10$, it becomes possible to provide an endless belt, as an intermediary transfer belt or a transfer material carrying belt for an image forming apparatus, not causing image failure due to the belt deformation nor belt rupture.

Other Embodiments

The image forming apparatus of the present invention is not limited to the above described full- color copying machine but may be embodied as printers or other copying machine.

What is claimed is:

1. A belt for being supported by a plurality of rollers and bearing thereon an image formed by image forming means or bearing thereon a transfer material onto which the image is transferred, said belt satisfying the following relationship:

$$1.5 \leqq \epsilon_{break}/\epsilon_{max} \leqq 10,$$

wherein $\epsilon_{max}$ represents the strain experienced by said belt at the time of applying to said belt a maximum stress value obtained from a stress-strain curve measured in accordance with JIS K7161 and K7162, and $\epsilon_{break}$ represents the strain experienced by said belt at a breaking point thereof.

2. A belt according to claim 1, wherein said belt comprises a base material which is made of a resinous material containing an electroconductivity-imparting agent.

3. A belt according to claim 2, wherein said electroconductivity-imparting agent is carbon black.

4. A belt according to claim 1, wherein said belt has a thickness of not less than 20 $\mu$m and not more than 500 $\mu$m.

5. A belt according to claim 1, wherein said belt has a thickness of not less than 50 $\mu$m and not more than 130 $\mu$m.

6. A belt according to claim 1, wherein said belt is an intermediary transfer belt configured to transfer the image borne thereon onto the transfer material.

7. A belt according to claim 1, wherein said belt is a transfer-material carrying belt which bears and carries the transfer material.

8. An image forming apparatus, comprising:

image forming means for forming an image, a belt for bearing thereon the image or bearing thereon a transfer material onto which the image is transferred, and a plurality of rollers by which said belt is supported, wherein said belt satisfies the following relationship:

$$1.5 \leqq \epsilon_{break}/\epsilon_{max} \leqq 10,$$

wherein $\epsilon_{max}$ represents the strain experienced by said belt at the time of applying to said belt a maximum stress value obtained from a stress-strain curve measured in accordance with JIS K7161 and K7162, and $\epsilon_{break}$ represents the strain experienced by said belt at a breaking point thereof.

9. An apparatus according to claim 8, wherein said belt comprises a base material which is made of a resinous material containing an electroconductivity-imparting agent.

10. An apparatus according to claim 9, wherein said electroconductivity-imparting agent is carbon black.

11. An apparatus according to claim 8, wherein said belt has a thickness of not less than 20 $\mu$m and not more than 500 $\mu$m.

12. An apparatus according to claim 8, wherein said belt has a thickness of not less than 50 $\mu$m and not more than 130 $\mu$m.

13. An apparatus according to claim 8, wherein said belt is an intermediary transfer belt configured to transfer the image beared thereon onto the transfer material.

14. An apparatus according to claim 8, wherein said belt is a transfer-material carrying belt which bears and carries the transfer material.

* * * * *

UNITED STATES PATENT AND TRADEMARK OFFICE

CERTIFICATE OF CORRECTION

PATENT NO. : 6,947,694 B2
DATED : September 20, 2005
INVENTOR(S) : Saito

It is certified that error appears in the above-identified patent and that said Letters Patent is hereby corrected as shown below:

Drawings,
Sheet 3, Fig. 3, “defomation” should read -- deformation --.

Column 2,
Line 18, “may” should read -- may be --.
Line 48, “driving” should read -- driving. --.

Column 3,
Line 18, “beltextension” should read -- belt-extension --.

Column 5,
Line 10, “fall-color” should read -- full-color --.

Column 7,
Lines 11 and 16, “An” should read -- A --.
Line 34, “desktoptype-materials” should read -- desktop-type-materials --.

Column 9,
Line 36, “above described” should read -- above-described --, and “full- color” should read -- full-color --.
Line 38, “machine.” should read -- machines. --.

Column 10,
Line 46, “beared” should read -- borne --.

Signed and Sealed this

Twenty-eighth Day of March, 2006

JON W. DUDAS
*Director of the United States Patent and Trademark Office*